United States Patent [19]

Vakil

[11] 4,290,272

[45] Sep. 22, 1981

[54] MEANS AND METHOD FOR INDEPENDENTLY CONTROLLING VAPOR COMPRESSION CYCLE DEVICE EVAPORATOR SUPERHEAT AND THERMAL TRANSFER CAPACITY

[75] Inventor: Himanshu B. Vakil, Schenectady, N.Y.

[73] Assignee: General Electric Company, Schenectady, N.Y.

[21] Appl. No.: 58,462

[22] Filed: Jul. 18, 1979

[51] Int. Cl.[3] ..... F25B 00/00

[52] U.S. Cl. ..... 62/114; 62/502; 62/208; 62/115; 62/132; 237/2 B

[58] Field of Search ..... 62/114, 502, 503, 509, 62/512, 174, 526, 225, 204, 205, 324 A, 208, 115, 132; 237/2 B

[56] References Cited

U.S. PATENT DOCUMENTS

| | | | |
|---|---|---|---|
| 2,739,450 | 3/1956 | Breck | 62/205 |
| 2,794,328 | 6/1957 | Herrick | 62/115 |
| 3,019,614 | 2/1962 | Schubert | 62/203 |
| 3,500,656 | 4/1968 | Lofgreen et al. | 62/196 |
| 3,875,755 | 4/1975 | Anderson et al. | 62/77 |
| 4,003,215 | 1/1977 | Roach | 62/476 |

OTHER PUBLICATIONS

Singer, Brochure Model 625 Thermal Electric Expansion Valve.

*Primary Examiner*—Lloyd L. King
*Assistant Examiner*—Henry Bennett
*Attorney, Agent, or Firm*—Robert R. Schroeder; James C. Davis, Jr.; Paul R. Webb, II

[57] ABSTRACT

A vapor compression cycle device with variable thermal capacity is provided with a means and a method for controlling device capacity modulation and evaporator superheat. Multi-component working fluid liquid flow from each of a pair of accumulators in a closed circuit device is regulated either in response to sensed thermal demand or in response to sensed working fluid vapor superheat.

11 Claims, 2 Drawing Figures

MEANS AND METHOD FOR INDEPENDENTLY CONTROLLING VAPOR COMPRESSION CYCLE DEVICE EVAPORATOR SUPERHEAT AND THERMAL TRANSFER CAPACITY

BACKGROUND OF THE INVENTION

This invention relates to vapor compression cycle devices and more particularly to a means and a method for controlling the modulation of both thermal capacity and evaporator superheat in such a device.

In a conventional vapor compression cycle device such as a heat pump a working fluid liquid is circulated through an expansion device into an evaporating heat exchanger where the working fluid absorbs heat. The heat vaporizes the working fluid liquid, and the resulting vapor is then circulated by a suitable compressor through a condensing heat exchanger where the vapor condenses into a liquid as heat is given off. The cycle is then repeated as the working fluid is recirculated through the system.

The quantity of heat required to vaporize the working fluid liquid is known as the heat of vaporization. Additional heat absorption by the resulting working fluid vapor causes an increase in the vapor temperature above the temperature of vaporization. This increase in vapor temperature is defined as superheat.

In conventional vapor compression cycle devices it is desirable to control the amount of superheat in the device cycle to achieve optimum system performance. Typically this control of superheat is effected by regulating the flow rate of working fluid liquid passing through the expansion device to the evaporator.

A vapor compression cycle device should also include means to modulate the capacity of the device to absorb and deliver heat, herein referred to as device thermal capacity, in response to variable heating and cooling demands in order to maximize efficiency. A device of this type is disclosed in U.S. Pat. No. 4,217,760. The thermal capacity of this device is modulated by regulating the amount of a multi-component working fluid allowed to flow from a first accumulator through an evaporator to a second accumulator located at a compressor inlet. As described in the cited application, this results in a change in the molar flow rate through the compressor and thus a change in device thermal capacity.

A device which includes means both for modulating device thermal capacity and for controlling the amount of evaporator superheat generated therein is disclosed in a later filed co-pending application Ser. No. 052,971, filed June 28, 1979, which is also assigned to the same assignee as the present invention. As in the earlier disclosed device described above, this latter device includes two accumulators. However, the second accumulator in the latter device is relocated intermediate two stages of an evaporating heat exchanger, and is adapted to decrease the time required to switch the device from a high to a low capacity mode of operation. Additionally, the evaporator superheat of the latter device is controllable through regulation of the amount of working fluid liquid allowed to flow from the second accumulator into the final evaporator stage.

The device disclosed in co-pending application Ser. No. 52,971 thus includes means whereby both evaporator superheat and device thermal capacity can be variably controlled. However, optimal performance of this device can require the coordinated adjustment of a plurality of flow restricting devices in response to sensed conditions.

Accordingly, it is an object of this invention to provide a new and improved means for controlling the modulation of the thermal capacity of a vapor compression cycle device.

Another object of the present invention is to provide a new and improved means for controlling the evaporator superheat of such a device.

Still another object of the present invention is to provide a new and improved means and method for the control of a vapor compression cycle device thermal capacity and evaporator superheat.

SUMMARY OF THE INVENTION

The above and other objects and advantages of the present invention are achieved through a means and a method for controlling the thermal capacity and evaporator superheat of a vapor compression cycle device employing a multicomponent working fluid in which the amount of working fluid liquid allowed to flow from each of a pair of accumulators is controlled either in response to sensed thermal demand or to sensed working fluid vapor superheat.

BRIEF DESCRIPTION OF THE DRAWING

For better understanding of the invention, reference may be made to the accompanying drawing wherein.

DESCRIPTION OF THE INVENTION

Figure 1:
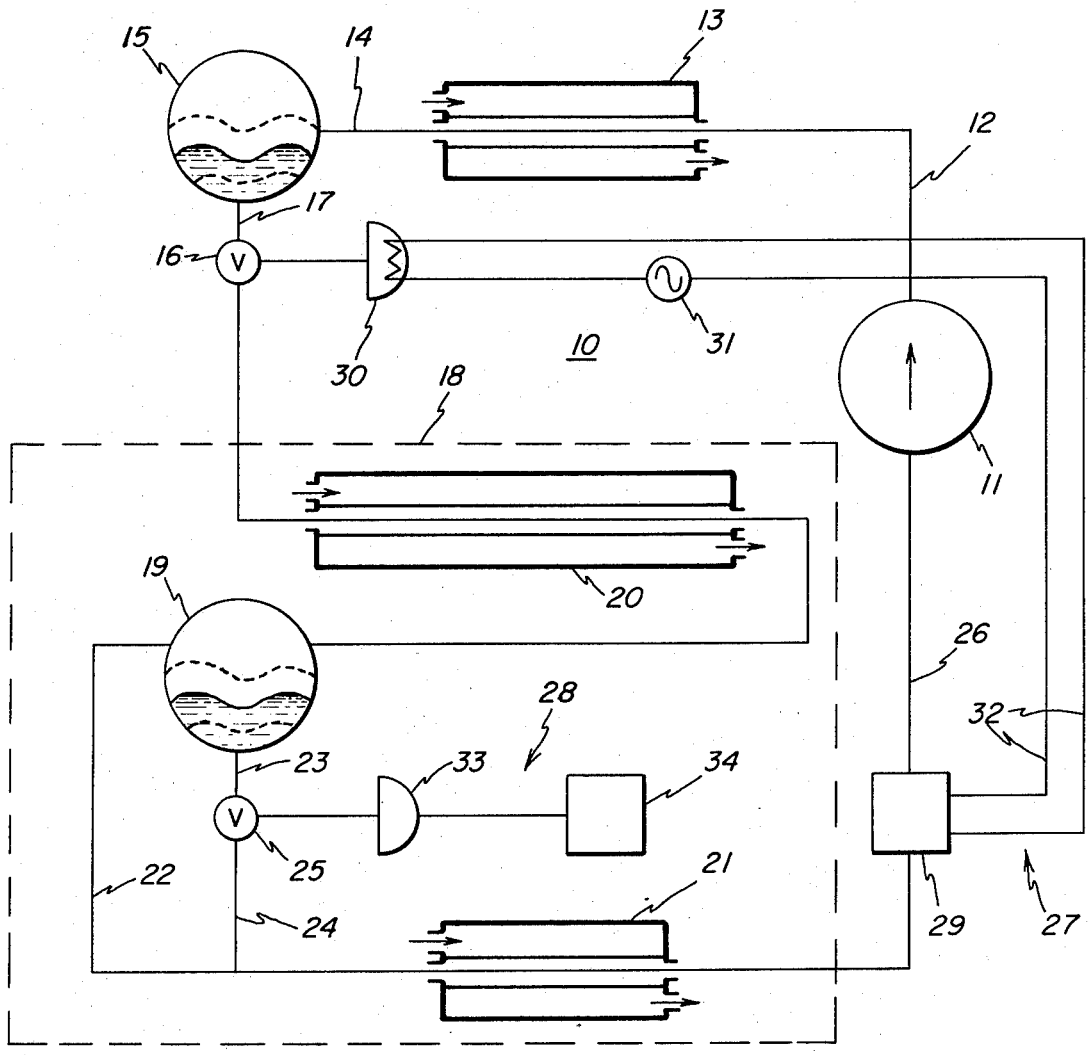
FIG. 1 is a schematic illustration of a vapor compression cycle device constructed in accordance with an embodiment of the present invention.
Figure 2:
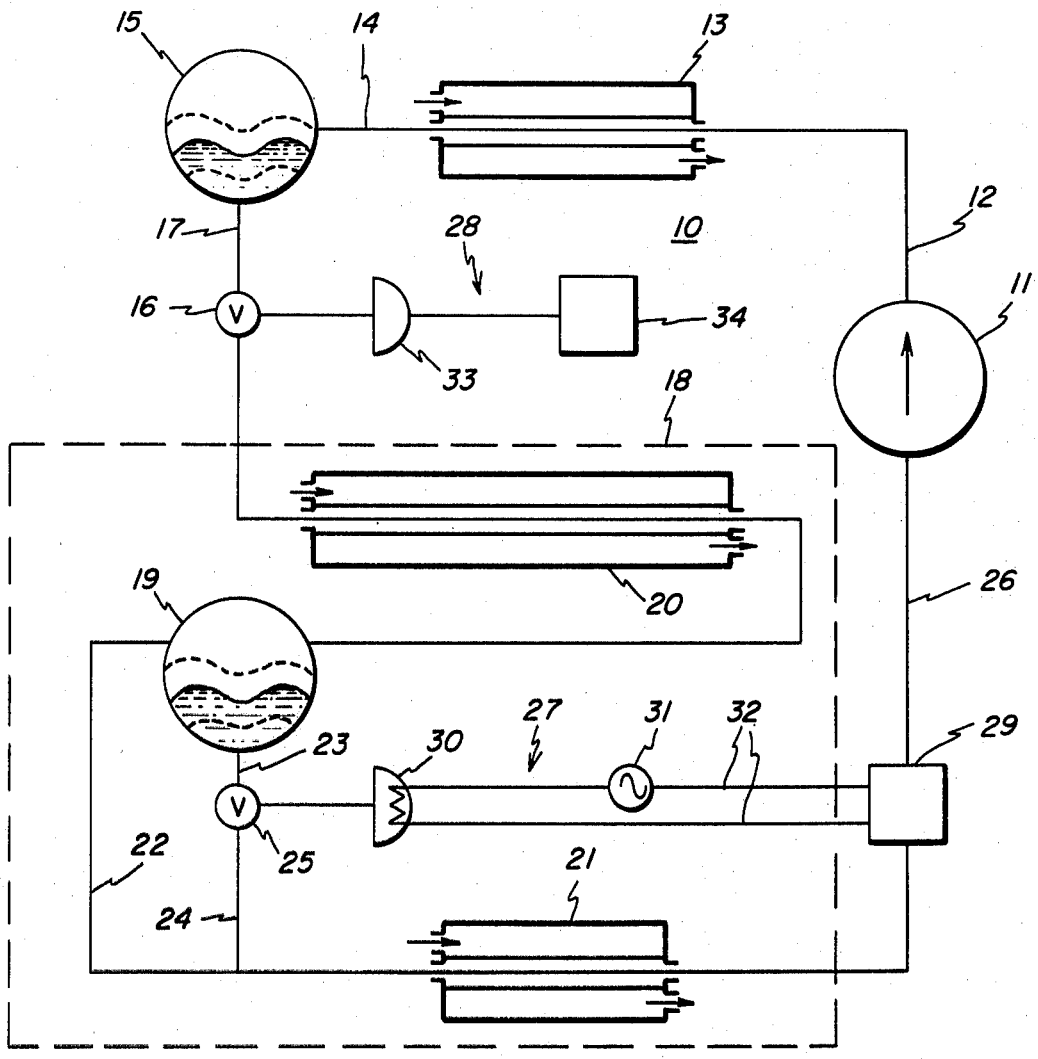
FIG. 2 is a view similar to that of FIG. 1 illustrating a second embodiment of the present invention.

In the exemplary embodiments of the invention depicted in FIGS. 1 and 2 of the drawing a heat pump 10 is shown in a heating mode of operation. However, it is to be understood that the present invention is not limited to heat pump applications. Furthermore, it is also understood that the present invention can be operated in a cooling mode of operation.

The device 10 is a closed cycle device in which a working fluid is circulated by a compressor 11 through a tube 12 to a condensing heat exchanger 13. After transferring its heat in the condenser 13 to the household, the working fluid flows through a tube 14 to a high pressure accumulator 15. The accumulator 15 may be of a conventional design or may be of a design such as disclosed in U.S. Pat. No. 4,179,898. The accumulator 15 is connected to an expansion valve 16 which controls the amount of the working fluid allowed to flow through a tube 17 to an evaporator assembly 18 where heat is absorbed by the fluid. The evaporator assembly includes a low pressure accumulator 19 connected intermediate a first evaporator stage 20 and a second evaporator stage 21. Thus, the working fluid entering the evaporator assembly 18 from the tube 17 flows through the first evaporator stage 20 to the low pressure accumulator 19 from which it then flows through lines 22 and 23 to the second evaporator stage 21. Tube 26 connects the outlet side of the evaporator assembly 18 to the inlet of the compressor 11 to effect a closed system.

The working fluid circulated in this closed system is a multi-component mixture of fluids which have different vapor pressures and which are miscible over the operative range of the device 10. In the preferred embodiment of the present invention, the working fluid is a multi-component fluorocarbon mixture. Such multi-component fluorocarbon mixtures can be selected for example from those disclosed in U.S. Pat. No. 4,003,215 issued Jan. 18, 1977, to John Roach.

The modulation of the capacity of the device 10 is accomplished by altering the density of the working fluid vapor at the inlet of the compressor 11. This effectively varies the molar flow rate through the compressor, thereby affecting the capacity of the device 10 to absorb and deliver heat to an associated household, or its thermal capacity. The compressor inlet density is dependent upon the vapor pressure thereat which is in part a function of the composition of the working fluid liquid collected in the low pressure accumulator 19. Thus, if the composition of this liquid is enriched with a low boiling point component of the working fluid mixture, the thermal capacity of the device 10 is correspondingly increased. Conversely, a decrease in the concentration of the low boiling point component in the liquid contained in the low pressure accumulator 19 will effect a decrease in the thermal capacity of the device.

The changing of the concentrations of the components of the liquid in the accumulator 19 is accomplished in part by adjusting the rate of flow from the accumulator 15. The high pressure accumulator 15 normally includes a higher concentration of the working fluid low boiling point component than does the liquid in the low pressure accumulator 19 due to equilibrium relationships between the working fluid vapor and liquid contained therein. Thus, to increase the capacity of the device 10 to transfer heat, the valve 16 is adjusted to augment the flow from the accumulator 15 such that the liquid level in the low pressure accumulator 19 is raised and the composition thereof is enriched with the low boiling point component of the working fluid. This then causes an increase in the compressor inlet density, and thus increases the thermal capacity of the device.

In order to decrease device thermal capacity upon increased outdoor temperature and associated decreased household thermal demand, the steps described above are reversed. To this end, the flow of the working fluid liquid from the accumulator 15 to the low pressure accumulator 19 is restricted by adjusting the valve 16. The low boiling point component in the liquid contained in the low pressure accumulator 19 is slowly depleted through evaporation by means of heat transfer from the vapor interfacing therewith.

To accomplish a more rapid transition from a high to a low capacity mode of operation, the device 10 as illustrated in FIGS. 1 and 2 includes tubes 23 and 24 and valve 25 which connect the liquid region of the accumulator 19 with the second evaporator stage 21. Thus, upon decreased thermal demand the valve 25 is opened a predetermined amount to allow a portion of the liquid in the accumulator 19 to flow into the second evaporator stage 21 along with the working fluid vapor flowing through the tube 22. The mixture is therein vaporized prior to entering the compressor inlet through a tube 26. In this manner, the time required to deplete the liquid level in the low pressure accumulator 19, and thus to decrease the thermal capacity of the device 10, is significantly reduced.

Additionally, the evaporator superheat of the device 10 is controlled by adjusting the valve 25 to augment or decrease the flow of working fluid liquid from the accumulator 17 to the second stage evaporator 21. More specifically, since the amount of heat transfer capability available for transfer to the working fluid flowing through the second stage evaporator 21 is fixed for a given set of conditions, then the amount of fluid flowing therethrough accordingly governs the possible temperature rise therein. Thus the temperature of the working fluid exiting the second stage evaporator 21, and hence evaporator superheat, is controllable by regulating the rate of working fluid flow through the valve 25.

Means for controlling the thermal capacity and the evaporator superheat of the vapor compression cycle device 10 include superheat responsive actuation means 27 and thermal demand responsive actuation means 28. More specifically, as illustrated in FIGS. 1 and 2, actuation means 27 preferably includes a wetness sensing thermistor 29 and a valve actuator 30 connected in series to a voltage supply 31 by leads 32. The wetness sensing thermistor 29 controls voltage output to the valve actuator 30 causing it to position the valve 16 such that a predetermined superheat condition in the suction line 26 of the compressor 11 is maintained. Actuation means of this type are commercially available from the Control Division of the Singer Company, Milwaukee, Wisconsin.

Although the thermistor 29 is depicted in FIGS. 1 and 2 positioned in the working fluid flow path after the second evaporator stage 21, it is to be understood that the thermistor could be positioned earlier in the flow path to allow a higher degree of fluid superheat. In particular, the thermistor can be positioned to sense the vapor quality of the working fluid at a predetermined point within the second evaporator stage, whereupon the fluid is heated a known amount in the portion of the evaporator following the thermistor to achieve a desired degree of fluid superheat at the inlet of the compressor 11.

Actuation means 28 includes a valve actuator 33 responsive to signals transmitted from a thermal demand sensing controller 34. In the preferred embodiment of the invention the thermal demand sensing controller 34 is a thermostat, however, it is understood that other thermal demand sensing devices can be substituted therefor. Thermal demand responsive actuation means of this type are also commercially available from the above-noted Singer Co.

In the embodiment of this invention illustrated in FIG. 1, the method of modulating the thermal capacity of the device 10 is initiated by a signal from the controller 34 corresponding to a sensed change in thermal demand. Upon a demand for increased device thermal capacity controller 34 signals valve actuator 33 to close valve 25 a predetermined amount, thereby decreasing the flow of working fluid liquid from the accumulator 19 through the heat exchanger 21. The decreased liquid flow results in an increased vapor superheat in the suction line 26 as sensed by the thermistor 29. Upon sensed increased vapor superheat the valve actuator 30 functions to open the cooperating valve 16 a predetermined amount, thereby augmenting the working fluid flow from the accumulator 15 to the evaporator assembly 18. The resulting increase in the concentration of the low boiling point component of the working fluid mixture in the accumulator 19 causes an increase in the molar flow rate through the compressor 11, thereby increasing the thermal capacity of the device 10.

Conversely, upon a decrease in thermal demand as sensed by the controller 34, the valve actuator 33 opens the valve 25 a predetermined amount to permit more liquid working fluid to flow from the accumulator 19. This increased flow of liquid causes a decrease of superheat in the working fluid vapor exiting the second evaporator stage 21, thereby causing the closing of the valve 16 by the actuator 30. This leads to a gradual depletion of working fluid liquid in the accumulator 19 and a gradual increase in liquid level in the accumulator 15. The thermal capacity of the device 10 thusly makes a gradual transition to a lower level of operation.

A variation on this first embodiment of the invention is illustrated in FIG. 2 of the drawing. In this embodiment the valve 16 is controlled by the thermal demand responsive actuation means 28, and valve 25 is controlled by the superheat responsive actuation means 27. Upon a sensed increase in thermal demand the controller 34 transmits a signal causing the valve actuator 33 to open the valve 16. This results in an increased flow of working fluid liquid from the accumulator 15 to the evaporator assembly 18, thereby increasing the concentration of the low boiling point component of the working fluid in the liquid contained in the accumulator 22 and causing an increase in the thermal capacity of the device 10. During this process the valve 25 is independently controlled by the actuation means 27 to meter out the amount of liquid required to maintain a predetermined degree of superheat at the exit of the evaporator assembly 18.

Upon a sensed need to decrease device thermal capacity the process is reversed wherein valve 16 is closed a predetermined amount resulting in less working fluid liquid entering the accumulator 19. This leads to a gradual depletion of the liquid in the accumulator 19 and a decrease in device thermal capacity. As in the preceding case the valve 25 is again independently controlled to maintain a predetermined degree of superheat at the exit of the evaporator assembly 18.

The above-described embodiments of this invention are intended to be examplative only and not limiting and it will be appreciated from the foregoing by those skilled in the art that many substitutions, alterations and changes may be made to the described structure and method without department from the spirit or scope of the invention.

What is claimed as new and desired to be secured by Letters Patent of the United States is:

1. A method for controlling the capacity and evaporator superheat of a vapor compression cycle device comprising the steps of:

compressing vapor of a miscible multicomponent working fluid mixture comprising at least two refrigerants having different boiling points, circulating the mixture vapor through a condensing heat exchanger, circulating mixture from the condensing heat exchanger to a high pressure accumulator, circulating a controlled amount of the mixture from the high pressure accumulator to a first evaporator stage in response to a sensed household thermal demand, circulating mixture from the first evaporator stage to a low pressure accumulator, controlling the circulation of the mixture from the low pressure accumulator to a second evaporator stage in response to the degree of mixture vapor superheat sensed at a point intermediate the second evaporator stage inlet and a compressor, and circulating the mixture exiting from the second evaporator stage to the compressor.

2. A method for controlling vapor compression cycle device capacity and evaporator superheat as in claim 1 wherein the amount of the mixture allowed to circulate from the high pressure accumulator to the first evaporator stage is increased with increasing household thermal demand.

3. A method for controlling vapor compression cycle device capacity and evaporator superheat as in claims 1 or 2 wherein the amount of the mixture allowed to circulate from the low pressure accumulator to the second evaporator stage is increased a predetermined amount corresponding to sensed increases in mixture vapor superheat.

4. A method for controlling vapor compression cycle device capacity and evaporator superheat comprising the following steps:

compressing vapor of a miscible multicomponent working fluid mixture comprising at least two refrigerants having different boiling points, circulating mixture vapor to a condensing heat exchanger, circulating the mixture liquid from the condensing heat exchanger to a high pressure accumulator, controlling the circulation of the mixture from the high pressure accumulator to a first evaporator stage in response to the degree of mixture vapor superheat sensed at a point in the device intermediate the inlet of a second evaporator stage and a compressor, circulating the mixture from the first evaporator stage to a low pressure accumulator, controlling the circulation of the mixture from the low pressure accumulator to the second evaporator stage in response to sensed household thermal demand, and circulating the mixture from the second evaporator stage to the compressor.

5. A method for controlling vapor compression cycle device capacity and evaporator superheat as in claim 4 wherein said circulation of mixture from the high pressure accumulator to the first evaporator stage is increased a predetermined amount corresponding to sensed increases in mixture vapor superheat.

6. A method for controlling vapor compression cycle device capacity and evaporator superheat as in claim 4 or 5 wherein said circulation of the mixture from the low pressure accumulator to the second evaporator stage is decreased with increasing household thermal demand.

7. In a vapor compression cycle device having a miscible multicomponent working fluid comprising at least two refrigerants with different boiling points which is circulated by a compressor through a condensing heat exchanger to a high pressure accumulator, an evaporator assembly connected at its inlet to said high pressure accumulator through a first flow restricting device and connected at its exhaust to said compressor, said evaporator assembly including a low pressure accumulator connected intermediate a first evaporator stage and a second evaporator stage with said connection to said second evaporator stage including a second flow restricting device, a means for controlling the capacity and the evaporator superheat of said vapor compression cycle device comprising:

a first actuation assembly including means for sensing working fluid vapor superheat at a point in the device intermediate said second flow restricting device and said compressor and an actuating means in cooperative engagement with said first flow restricting device for regulating the amount of working fluid flowing through said first flow restricting device in response to a signal from said vapor superheat sensing means; and a second actuation assembly including a thermal demand sensing means and an actuating means in cooperative engagement with said second flow restricting device for regulating the amount of working fluid flowing through said flow restricting device in response to a signal from said demand sensing means.

8. In a vapor compression cycle device having a multicomponent working fluid circulated by a compressor through a condensing heat exchanger to a high pressure accumulator, an evaporator assembly connected at its inlet to said high pressure accumulator through a first flow restricting device and connected at its exhaust to said compressor, said evaporator assembly including a low pressure accumulator connected intermediate a first evaporator stage and a second evaporator stage with said connection to said second evaporator stage including a second flow restricting device, a means for controlling the capacity and the evaporator superheat of said vapor compression cycle device comprising:

a first actuation assembly including means for sensing working fluid vapor superheat at a point in the device intermediate said second flow restricting device and said compressor and an actuating means in cooperative engagement with said second flow restricting device for regulating the amount of working fluid flowing through said second flow restricting device in response to a signal from said vapor superheat sensing means; and a second actuation assembly including a thermal demand sensing means and an actuating means in cooperative engagement with said first flow restricting device for regulating the amount of working fluid flowing through said first flow restricting device in response to a signal from said demand sensing means.

9. A means for controlling vapor compression cycle device capacity and evaporator superheat as in claim 7 or 8 wherein said vapor superheat sensing means is a thermistor.

10. A means for controlling vapor compression cycle device capacity and evaporator superheat as in claim 7 or 8 wherein said vapor superheat sensing means is disposed intermediate said second evaporator stage inlet and said compressor inlet.

11. A means for controlling vapor compression cycle device capacity and evaporator superheat as in claim 7 or 8 wherein said demand sensing means is a thermostat.

* * * * *